US008562038B2

(12) United States Patent
Liebscher et al.

(10) Patent No.: US 8,562,038 B2
(45) Date of Patent: Oct. 22, 2013

(54) MANUAL UNLOCKING UNIT FOR A SLIDING DOOR

(75) Inventors: Arne Liebscher, Herdecke (DE); Andreas Finke, Gevelsberg (DE)

(73) Assignee: Dorma GmbH+Co. KG, Ennepetal (DE)

( * ) Notice: Subject to any disclaimer, the term of this patent is extended or adjusted under 35 U.S.C. 154(b) by 1096 days.

(21) Appl. No.: 11/793,832

(22) PCT Filed: Dec. 2, 2005

(86) PCT No.: PCT/EP2005/012901
§ 371 (c)(1),
(2), (4) Date: Jun. 22, 2007

(87) PCT Pub. No.: WO2006/072299
PCT Pub. Date: Jul. 13, 2006

(65) Prior Publication Data

US 2008/0127685 A1 Jun. 5, 2008

(30) Foreign Application Priority Data

Dec. 22, 2004 (DE) ..... 10 2004 062 995

(51) Int. Cl.
*E05B 3/00* (2006.01)

(52) U.S. Cl.
USPC ..... 292/336.3; 292/144; 292/DIG. 46; 292/DIG. 47

(58) Field of Classification Search
USPC ..... 292/336.3, 144, 201, DIG. 46, DIG. 37; 70/276–282, 413
See application file for complete search history.

(56) References Cited

U.S. PATENT DOCUMENTS

| | | | | |
|---|---|---|---|---|
| 3,000,203 | A | 9/1961 | Olsen | |
| 3,683,652 | A | 8/1972 | Halopoff et al. | |
| 4,080,757 | A | 3/1978 | Westerman | |
| 5,509,233 | A * | 4/1996 | Peterson | 49/139 |
| 5,823,026 | A | 10/1998 | Finke | |
| 5,947,536 | A | 9/1999 | Mizuki et al. | |
| 7,011,347 | B2 * | 3/2006 | Finardi | 292/171 |
| 7,222,459 | B2 * | 5/2007 | Taniyama | 49/280 |
| 7,537,038 | B2 * | 5/2009 | Hsieh | 160/9 |
| 2003/0047951 | A1 * | 3/2003 | Belchine et al. | 292/336.3 |

FOREIGN PATENT DOCUMENTS

| | | |
|---|---|---|
| DE | 32 48 498 | 7/1984 |
| DE | 85 29 024 | 2/1987 |
| DE | 41 24 944 | 8/1992 |
| DE | 4124944 C * | 8/1992 |
| DE | 195 01 420 | 12/1995 |
| EP | 1 403 452 | 3/2004 |
| FR | 2 755 458 | 5/1998 |

OTHER PUBLICATIONS

Search Report dated Feb. 16, 2006 for the underlying International Application No. PCT/EP2005/012901.

* cited by examiner

*Primary Examiner* — Carlos Lugo
*Assistant Examiner* — Mark Williams
(74) *Attorney, Agent, or Firm* — Cozen O'Connor

(57) ABSTRACT

A manual unlocking unit for a sliding door is disclosed. The unlocking unit includes a pivotable lever element comprising a plurality of abutments; a cable having a first end connectable to an unlocking device for the sliding door and a second end connected to the lever element, the cable being tensioned to actuate the unlocking device; and an actuating element actable on at least one of the plural abutments for pivoting the lever element. Each of the plural abutments is configured for receiving a tension or pressure actuating force from the actuating element.

14 Claims, 3 Drawing Sheets

MANUAL UNLOCKING UNIT FOR A SLIDING DOOR

CROSS-REFERENCE TO RELATED APPLICATIONS

This is a U.S. national stage of International Application No. PCT/EP2005/012901, filed on 2 Dec. 2005. Priority is claimed on German Application No. 10 2004 062 995.1, filed on 22 Dec. 2004.

BACKGROUND OF THE INVENTION

1. Field of the Invention

The invention relates to a manual unlocking unit for a sliding door, with a Bowden cable, which is tension-resistantly connected to an unlocking device at the one end and, at the other end, to a manually pivotable lever element, the pivoting of the lever element being accomplished by means of an actuating element acting on the lever element 2. Description of the Related Art Regularly, the drive of modern sliding doors is electric; the same applies to the arresting of the travelling leaves in the closed or opened positions. Usually an activation through appropriately energizing stable or bistable electromagnets is employed for the locking or unlocking itself. An optional manual unlocking component is desirable or required for the purpose of reliable operability.

A manual unlocking unit of the species mentioned at the beginning is disclosed in DE 41 24 944 A1. In the prior art device, a traction rod is provided which, via an angled lever, actuates a Bowden cable, i.e. there is only one disposition possibility for the actuating element formed as a traction rod, such that a more suitable, different disposition of the actuating element, for example based on structural conditions or on the practicability of manipulation, can not be considered.

The same applies to the manual locking device according to DE 195 01 420 C1, where the locking or the unlocking, controlled by a bi-stable electromagnet, can be complemented by a manual unlocking device, with the electromagnet not being energized. Here again, the connection of the Bowden cable to the mounting plate does not allow for a more suitable, different disposition or for a another choice of an actuating element. Disclosed is merely the replacement of the Bowden cable by a rod assembly, what is likewise valid in equivalent terms for the subject matter of the application.

SUMMARY OF THE INVENTION

It is an object of the invention to improve a manual unlocking unit of the species mentioned at the beginning in that, with a basically identical configuration of the manual unlocking unit and thus of the pivotable lever element as well, different actuating elements can be employed.

The invention solves the given problem with a manual unlocking unit for a sliding door. The unlocking unit includes a pivotable lever element comprising a plurality of abutments; a cable having a first end connectable to an unlocking device for the sliding door and a second end connected to the lever element, the cable being tensioned to actuate the unlocking device; and an actuating element actable on at least one of the plural abutments for pivoting the lever element. Each of the plural abutments is configured for receiving a tension or pressure actuating force from the actuating element.

According to the measure of associating several abutments or dogs to the same lever element for the optional tension-resistant and/or pressure-resistant application of an actuating element, the actuating element, with the manual unlocking unit having the same configuration, can be formed, for example, in a known manner as a traction element; in particular with the actuating element being supported inside the inner covering of the driving profile, the use of a push-button can prove to be advantageous, because, in this case, there is no tension-resistant connection to the dog, which constitutes a component of the pivotable lever element, such that the above mentioned connection does not need to be released, if the inner covering is required to swing out for the purpose of necessary installation or maintenance work. Depending on structural conditions, the choice of the actuating element is possible, in each case likewise depending on the aspect of safety including visual requirements (a push-button as actuating element is hardly visible) or on the practicability of the manipulation.

Further preferred embodiments of the invention will become apparent from the following discussion.

In a development of the invention, two abutments, offset by 90°, are disposed at the lever element, each abutment having apertures for the tension-resistant connection of a Bowden cable. The offset by 90° allows for the optional connection of the Bowden cable—which may be substituted by a lever assembly as an equivalent—to the one or to the other abutment respectively, requiring simply to pivot the lever element by 90° prior to installation. An appropriate disposition of the actuating elements—as a rule inside the inner covering of the driving profile—allows furthermore for forming the actuating element optionally as a push-button acting on a contact surface of an abutment or as a traction rod, which is tension-resistantly connected to an aperture of an abutment.

The abutments themselves may consist of flange-like cranks disposed at a base plate of the lever element; since an automatic reset of the pivoting element, after being charged by the push-button or by the traction rod, is required, a return spring is employed in a known manner, the pivoting path for the actuation of the push-button or of the traction rod, as well as for the charging through the return spring is limited by stop dogs, which are disposed at a mounting plate accommodating the pivoting axle of the lever element.

It has proven to be suitable to support the push-button and/or the traction rod axially displaceable in a bushing, which is disposed inside an inner covering of the driving profile. Thus, in the preferred embodiment, only the actuating element is supported inside the inner covering; the manual unlocking unit itself is connected to the driving profile. Basically, also the manual unlocking device could bear on the inner covering, what allows for a more precise association of the actuating elements to the abutments, what in return is disadvantageous in that, in the event of dismounting the covering, the Bowden cable or the manual unlocking unit need to be uninstalled. This does not affect the basically optional use of different actuating elements. The same applies to the structural development of the actuating elements; in this case, the actuation of the abutments can be realized for example via a rotating knob mounted to the rear side inside the covering and having an eccentric part, which acts on the abutments.

In adaptation to the different development of the inner covering—in particular to its height—it is further suggested in the invention that an extension, which is adjustable against the abutment, be disposed at the push-button.

As a consequence of the tension-resistant connection of the traction rod to the associated abutment, it has proven to be suitable that the traction rod be connected to an adapter component, which is tension-resistantly connected to the abutment and disposed within the inner covering. Releasing the traction rod from the adapter component allows for unhindered swinging out the inner covering when maintenance or repair work is required.

The possibility of pivoting the lever element by 90° and thus the possibility of pivoting the abutments by 90° allows for the optional connection of the Bowden cable or of a corresponding rod assembly to one of the two abutments respectively, each abutment having a bore for the purpose of attaching the Bowden cable.

As a result, the invention proposes a solution, in which, with an absolutely identically formed pivoting element, differently formed actuating elements can be optionally used, while matching respective requirements.

BRIEF DESCRIPTION OF THE DRAWINGS

Hereinafter, the invention will be explained in more detail on the basis of two exemplary embodiments.

FIG. 1 a vertical cross section through the manual unlocking unit using a push-button, FIG. 2 a view, offset by 90° with regard to FIG. 1, of the manual unlocking unit with the non-activated push-button, FIG. 3 a view according to FIG. 2 with the activated push-button, FIG. 4 a view according to FIG. 1 with a push-button extension, FIG. 8 a perspective illustration of the manual unlocking unit using a push-button according to FIGS. 1 to 4, FIGS. 5 to 7 and 9 show a second exemplary embodiment, FIG. 5 a vertical cross-section through the manual unlocking unit using a traction rod that is separable, FIG. 6 a view, offset by 90° with regard to FIG. 5, of the manual unlocking unit with the non-activated traction rod, FIG. 7 a view according to FIG. 6 with the activated traction rod, and FIG. 9 a perspective illustration of the manual unlocking unit using a traction rod according to FIGS. 5 to 7.

DETAILED DESCRIPTION OF THE PREFERRED EMBODIMENTS

Figure 1:
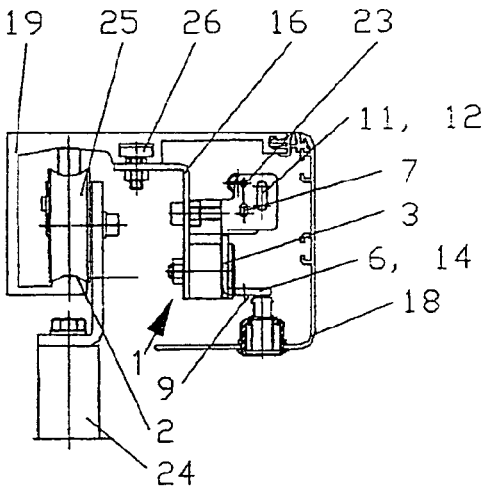
FIGS. 1 to 4 and 8 show a first exemplary embodiment.

The manual unlocking unit 1 according to FIG. 1 shows the driving profile 19 in a cross-section, in which the travelling door leaf 24 is guided by means of a carrying roller 25. Both the manual unlocking unit 1, via mounting plate 16, and the inner covering 18 are connected to the driving profile 19 by means of an attachment device 26.

Figure 4:
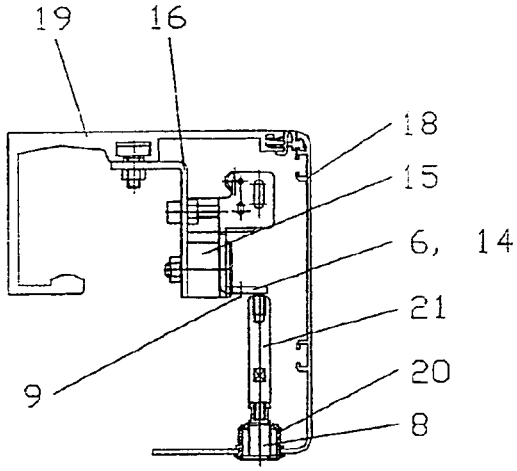
Figure 2:
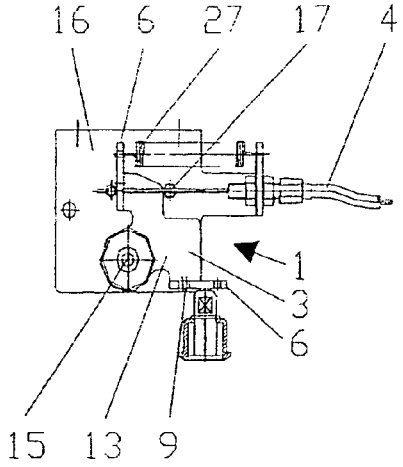
Figure 3:
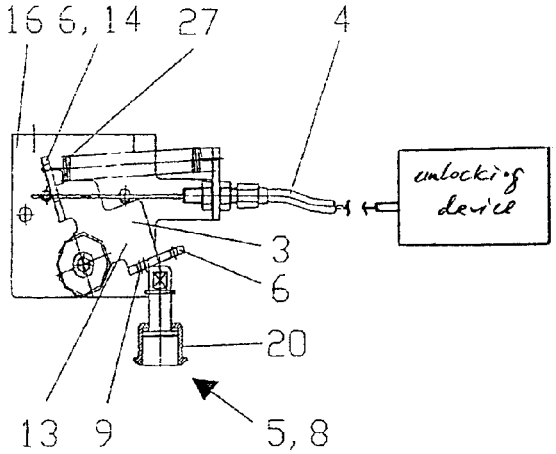

According to FIGS. 2 and 3, the manual unlocking unit 1 essentially consists of a lever element 3, pivotable by 90° about a pivot axis 15, which has abutments 6, likewise offset by 90°, which are constituted by cranks 14 of the base plate 13. A Bowden cable 4, which passes through an aperture 7, is connected to one of the two abutments 6 and is returned by means of a spring 27. The actuating element generally indicated at 5 is formed as a push-button 8 in FIGS. 1 to 4, which acts on a contact surface 9 of the abutment 6. The push-button 8 is axially displaceably supported in a bushing 20 passing through the inner covering 18. In adaptation to an inner covering 18 having an increased height, according to FIG. 4, an extension 21 adapted to the structural height of the inner covering 18 is associated to the push-button 8 by means of a screw connection.

The pivot path of the lever element 3 is limited in both pivot directions by a stop dog 17.

Figure 5:
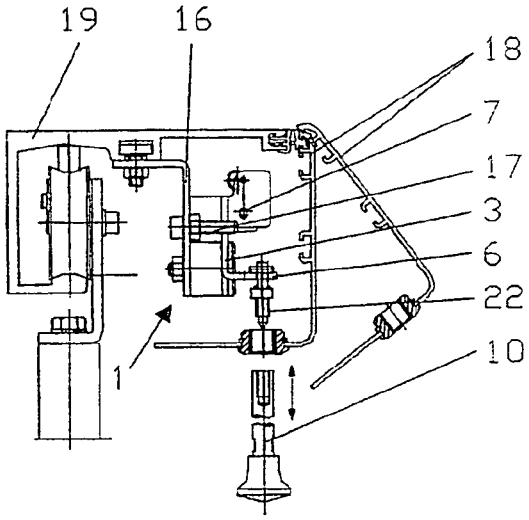
Figure 6:
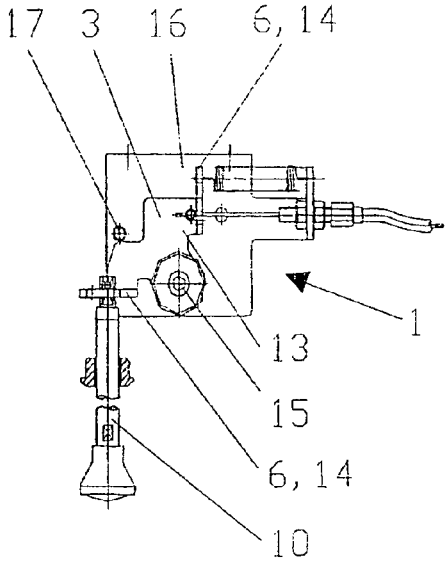
Figure 7:
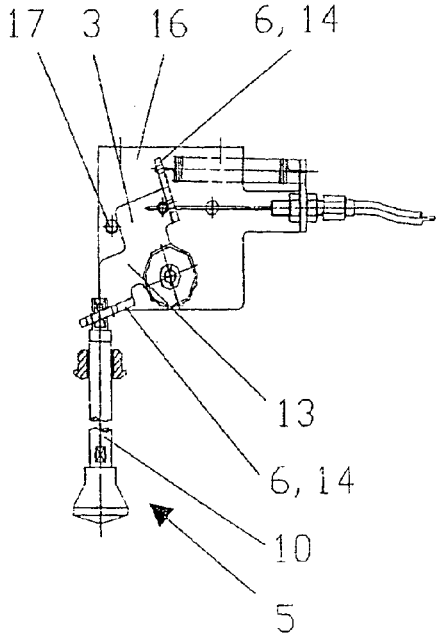
Figure 8:
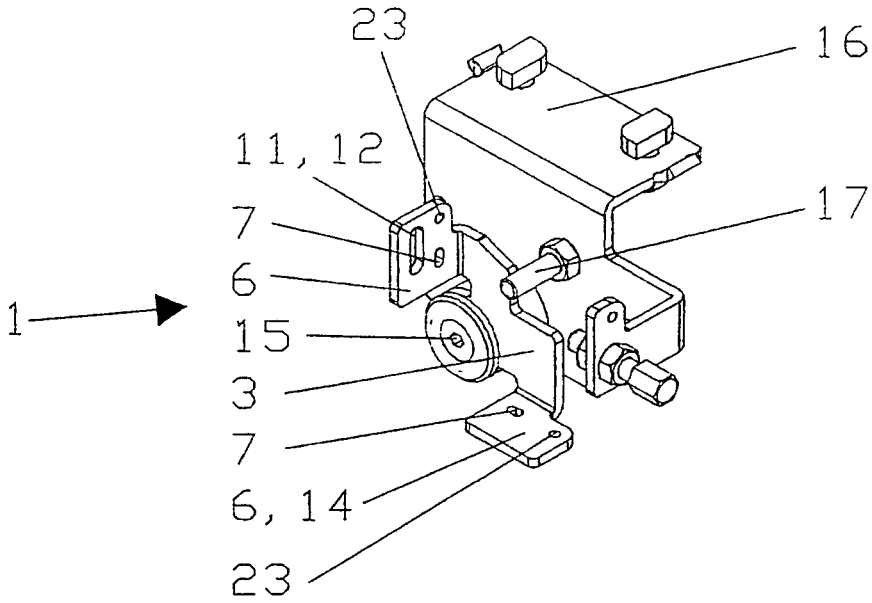
Figure 9:
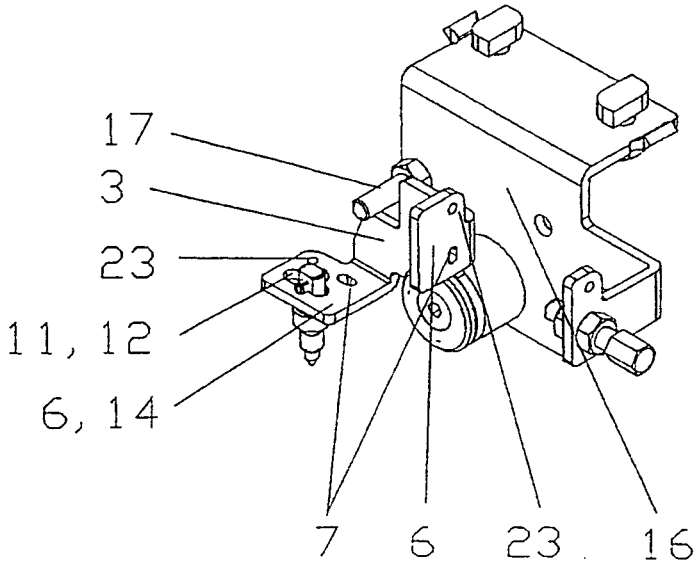

In the exemplary embodiment according to FIGS. 5 to 7, a traction rod 10 is used as an actuating element 5. With its free end, the traction rod 10 passes through an aperture 11 formed as an oblong hole 12 in the abutment 6 and is thus secured against rotation about its longitudinal axis. It can be seen, that, according to FIGS. 5 to 7, the Bowden cable 4, after pivoting the base plate 13 of the lever element 3, now acts on the abutment 6, which is offset by 90°.

As, in contrast to the push-button 8, the traction rod 10 acts tension-resistantly on the abutment 6, as shown in FIG. 5, an axial separation of the traction rod 10 is required in the direction of the arrow, in order to allow for swinging the inner covering 18 out, for the purpose of maintenance or repair work. For this purpose, an adapter component 22 is provided, which is secured to the abutment 6 and releasably connected to the traction rod 10.

What is claimed is:

1. A manual unlocking unit for a sliding door, comprising:

a pivotable lever element mounted at a pivot point comprising a plurality of dogs, each of the dogs is configured to receive a tension or pressure actuating force;

a cable having a first end connected to an unlocking device for the sliding door and a second end connected to one of the plural dogs of the lever element; and an actuating element comprising at least one of a push button and a traction rod, wherein the actuating element is actable on at least one of the plural dogs for pivoting the lever element, wherein each of the plural dogs is configured for receiving the tension or pressure actuating force from the actuating element such that the pivotable lever element is configurable for receiving the tension actuating force in a first configuration when mounted in a first position at the pivot point and for receiving the pressure actuating force in a second configuration when mounted in a second position at the pivot point to transmit the actuation force from the actuating element for pivoting movement of the lever element, thereby tensioning the cable and actuating the unlocking device.

2. The manual unlocking unit of claim 1, wherein the plural dogs comprise two dogs which are offset from each other by 90° relative to a pivoting axis of the pivotable lever element.

3. The manual unlocking unit of claim 2, wherein each of the two dogs has a respective first aperture, the actuating element being actable on the one of the two dogs and the cable being connected to the other of the two dogs through the first aperture thereof.

4. The manual unlocking unit of claim 3, wherein the actuating element is a push button and wherein the one of the two dogs configured for receiving the pressure actuating force has a contact surface, the push-button is actable on the contact surface of the dogs configured for receiving the pressure actuating force to transmit the pressure actuating force from the actuating element to the other of the two dogs.

5. The manual unlocking unit of claim 4, wherein the push-button is axially displaceably supported in a push-button bushing which is supported by and disposed inside an inner covering.

6. The manual unlocking unit of claim 4, further comprising an adjustable extension which is mounted on the push-button and actable on the contact surface of the other of the two dogs.

7. The manual unlocking unit of claim 3, wherein the first aperture is oblong-shaped.

8. The manual unlocking unit of claim 3, wherein the first aperture of the other of the two dogs is a bore, wherein the cable extends through the first aperture of the other of the two dogs, and the other of the plural dogs is connected to a return spring.

9. The manual unlocking unit of claim 2, wherein the lever element comprises a base plate and two flange-shaped cranks on the base plate, the cranks forming the two dogs.

10. The manual unlocking unit of claim 1, further comprising a mounting plate on which the lever element is pivotably mounted, and a stop dog which is mounted on the mounting plate for delimiting a pivot path of the lever element.

11. The manual unlocking unit of claim 1, wherein the actuating element comprising is a traction rod and the traction rod is axially displaceably supported in a traction rod bushing which is supported by and disposed inside an inner covering.

12. The manual unlocking unit of claim 1, further comprising an adapter component which is connected to the one of the plural dogs and disposed within an inner covering, the traction rod being releasably connected to the adapter component.

13. The manual unlocking unit of claim 1, wherein the cable comprises a Bowden cable.

14. The manual unlocking unit of claim 1, wherein the manual actuating element comprises a traction rod, wherein one of the dogs has a second aperture, and wherein the traction rod, with an end thereof, is attached to and is configured to extend through the second aperture of the one of the dogs that is configured for receiving the tension actuating force to transmit the tension actuating force from the actuating element to the one of the dogs which the actuating element is attached.

* * * * *